US006467121B1

(12) United States Patent
Franzino et al.

(10) Patent No.: US 6,467,121 B1
(45) Date of Patent: Oct. 22, 2002

(54) ROTARY TUBE SCRUBBER

(75) Inventors: Joseph J. Franzino, Huntington; William W. Coville, Stamford, both of CT (US)

(73) Assignee: Goodway Technologies Corporation, Stamford, CT (US)

( * ) Notice: Subject to any disclaimer, the term of this patent is extended or adjusted under 35 U.S.C. 154(b) by 0 days.

(21) Appl. No.: 09/640,108

(22) Filed: Aug. 15, 2000

(51) Int. Cl.[7] ..... B08B 9/047

(52) U.S. Cl. ..... 15/104.09; 15/104.14; 15/236.1

(58) Field of Search ..... 15/93.1, 104.09, 15/104.095, 104.096, 104.13, 104.14, 104.15, 236.06, 236.1

(56) References Cited

U.S. PATENT DOCUMENTS 2,164,689 A * 7/1939 Shobe
2,221,195 A * 11/1940 Ketsios
2,348,132 A * 5/1944 Hyland
2,402,223 A * 6/1946 Wright
2,809,815 A * 10/1957 Born
3,171,149 A * 3/1965 Ciaccio
4,210,976 A * 7/1980 Apelt et al.
4,783,875 A * 11/1988 Cottam

* cited by examiner

*Primary Examiner*—Terrence R. Till
(74) *Attorney, Agent, or Firm*—Patrick J. Walsh

(57) ABSTRACT

A tube scrubber comprises an elongate body symmetrical about its longitudinal axis, having a central core with threaded stem for connection to a rotary driving device, and a plurality of flexible arms or webs extending outward from the central core and terminating in longitudinally extending cutting edges which scrub the inner surface of a boiler tube and the like.

10 Claims, 1 Drawing Sheet

ROTARY TUBE SCRUBBER

BACKGROUND OF THE INVENTION

The present invention relates to cleaning boiler tubes and particularly to a rotary scrubber for cleaning tubes.

Commercial tube cleaning equipment ordinarily uses a rotary brush for cleaning the inner surface of tubes and pipes of power plant equipment and machines such as boilers, chillers, condensers, heat exchangers, absorption machines and so forth. These brushes have a twisted steel wire spine securing bristles as illustrated in U.S. Pat. No 5,235,718.

In operation, conventional tube cleaning equipment passes the rotary brush through each tube to scrub soot and dirt from the tube surface. The rotary brush is accompanied by a stream of water to flush scrubbed soot and dirt from the tube.

Standard brushes are sized specifically to tube size so that for tubes of different diameters, separate sized brushes must be used for efficient tube cleaning. In addition, brushes wear down and must be replaced from time to time.

The twisted steel spine of the rotary brush can mar delicate tube walls.

The stream of flushing water injected into a tube backs up behind the rotary brush and there is a back flow of flushing water when the rotary brush is retracted from the tube after a cleaning pass.

The present invention is directed to a new and useful scrubber that surpasses the limitations inherent in use of standard bristle brushes for tube scrubbing operations.

SUMMARY OF THE INVENTION

A tube scrubber according to the invention comprises a one piece elongate body symmetrical about its longitudinal axis, having a central core with threaded stem for connection to a rotary driving device, and a plurality (preferably three) of flexible wing-like arms or webs extending outward from the central core and terminating in longitudinally extending cutting edges which scrub dirt or soot from the inner surface of a boiler tube and the like.

The central core is essentially a round shaft with imaginary parallel longitudinal surface lines (preferably three) spaced 120° circumferentially about the shaft such that the imaginary lines define places of attachment of the flexible arms to the core.

Each flexible arm is a web-like curved plane preferably approximating the shape of one-fourth of a cylinder wall defined by parallel inner and outer edges. The inner edge of each flexible arm is integral with the core along one of the imaginary lines with the arm projecting outwardly from the core curving approximately 90° from the line of attachment and terminating at the outer edge. The outer edge includes an integral cutting edge for engaging and scrubbing tube walls.

The flexible arm construction allows the scrubber to compensate for wear in that the arms flex outwardly to maintain engagement with tube surface as the arm cutting edges wear in use.

So, the scrubber preferably includes three longitudinally extending cutting edges, with the edges being spaced approximately 120° apart for scrubbing engagement with the cylindrical inner surface of a boiler tube, for example. The flexible arm design enables use of the scrubber in a one-eight inch range of tube diameter sizes in contrast to conventional brushes which are limited to use in a single tube size. The cutting edge configuration results in self sharpening of the scrubber edges as they engage and scrub tube walls.

The spaces between adjacent flexible scrubber arms define longitudinal passages through the scrubber for free flow of flushing water in a tube particularly as the scrubber is retracted from the tube after each cleaning pass.

The length of each flexible arm and its cutting edge is approximately the same as the length of the elongate core body of the scrubber.

The scrubber is preferably fabricated of a durable plastic such as nylon.

By way of comparison to a conventional bristle brush, the present invention provides a tube scrubber that cleans a tube twice as fast for the same feed rate of the scrubber through a tube, provides a single size scrubber for a range of tube diameter sizes, does not mar delicate tube surfaces, self-compensates for wear, self-sharpens its cutting edges, and allows faster flow of flushing water when retracting the scrubber from a tube.

OBJECTS OF THE INVENTION

An object of the invention is to provide a tube scrubber that surpasses limitations inhering in use of conventional bristle brushes.

Another object of the invention is to provide a one-piece tube scrubber with flexible scrubbing arms wherein a scrubber of one size is useful in a range of tube sizes and wherein the flexible arms self-compensate for wear.

Another object of the invention is to provide a one-piece tube scrubber with flexible scrubbing arms having longitudinal passages between adjacent arms to accommodate free flow of tube flushing water past the scrubber in the course of tube scrubbing.

Another object of the invention is to provide a one-piece tube scrubber with flexible scrubbing arms with self-sharpening cutting edges.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 3:
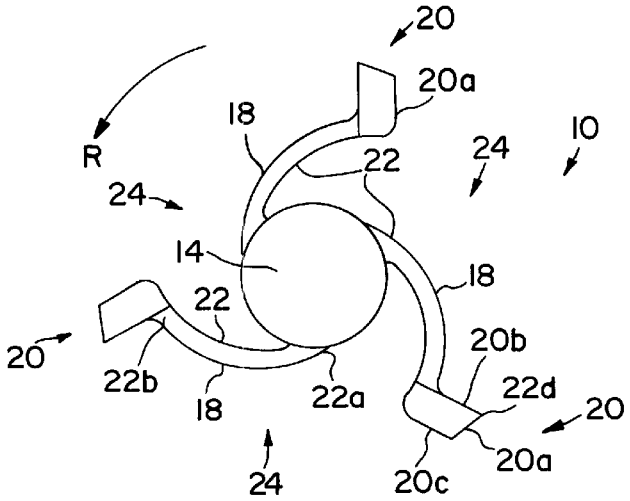
FIG. 3 is an end view of the scrubber of FIG. 1.

Referring to the drawing, a preferred embodiment of the tube scrubber 10 comprises a molded one piece plastic elongate body 12 symmetrical about its longitudinal axis X–X'. The body includes a central core with threaded stem 16 for connection to a rotary driving device (not shown) of a tube cleaning machine. A plurality (preferably three) of flexible arms 18 extend outward from the central core 14 and terminate in longitudinally extending cutting edges 20. The cutting edges scrub dirt or soot from the inner surface S of a tube T (FIG. 3).

The central core 14 is essentially a round shaft with imaginary parallel longitudinal surface lines A–A' equally spaced circumferentially about the shaft. Lines A–A' indicate the place and orientation of attachment of the flexible arms to the core.

The arms 18 are curved so as to flex radially for centering the scrubber axially in a tube, and to urge the cutting edges into firm scrubbing engagement with tube wall S. In preferred embodiment, each flexible arm 18 comprises a thin curved panel 22 preferably approximating the shape of one-fourth of a cylinder wall defined by parallel inner 22*a* and outer edges 22*b*. The inner edge of each flexible arm is integral with the core along one of the lines A–A' with he arm projecting outwardly from the core curving approximately 90° from the line of attachment and terminating at the outer edge 22*b*. The outer edge mounts an integral cutting edge for scrubbing tube walls.

Figure 1:
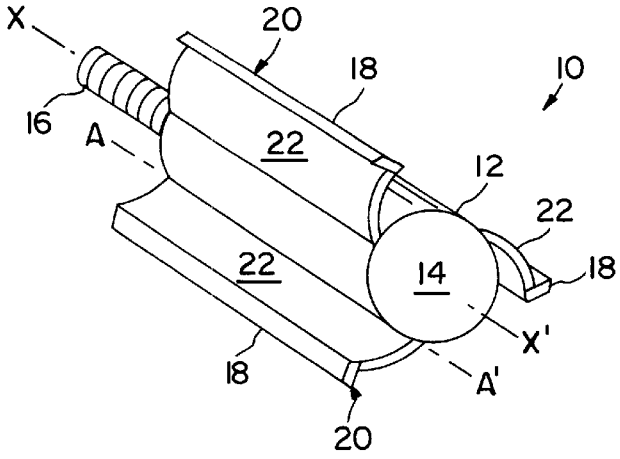
FIG. 1 is perspective view of a tube scrubber according to the invention.
Figure 2:
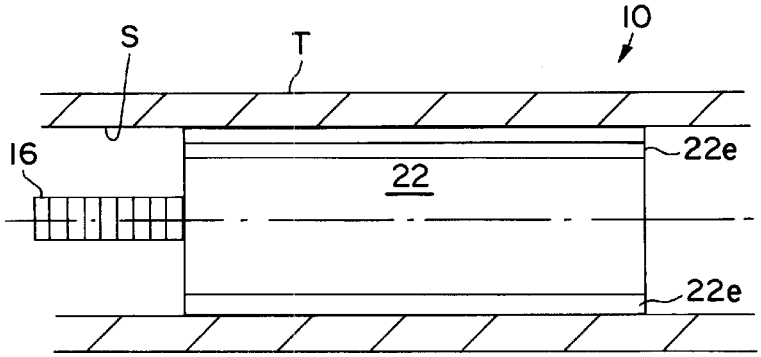
FIG. 2 is a side elevation of the scrubber of FIG. 1 positioned in a tube shown in section.

Each cutting edge 20 is an elongate strip integral with its supporting arm 22 and has a bevelled side 20*a* for engaging and scrubbing a tube wall. The bevelled edge tapers from the front face 20*b* to rear face 20*c* of the strip defining an acute scrubbing edge 20*d* which engages a tube wall for removing soot as the scrubber rotates in direction R. The length of each cutting edge is approximately the same as the length of the body of the scrubber. The cutting edge configuration results in self sharpening of the scrubber edges as they engage and scrub tube walls. As best shown in FIG. 2, the forward end 22*e* of the cutting edge strips is trimmed for ease of inserting the scrubber into a tube opening.

In preferred form, there are three longitudinally extending cutting edges, with the edges being spaced equally about the scrubber for engagement with the tube wall. The flexible arm design enables use of a scrubber of given size in a one-eight inch range of tube diameter sizes.

The spaces between adjacent arms define longitudinal passages 24 for free flow of flushing water in a tube particularly as the scrubber is retracted from the tube after each cleaning pass.

Various changes may be made to the structure embodying the principles of the invention. The foregoing embodiments are set forth in an illustrative and not in a limiting sense. The scope of the invention is defined by the claims appended hereto.

We claim:

1. A tube scrubber comprising an elongate body having a central core with means for connection to a rotary driving device, a plurality of flexible arms spaced about the circumference of the core and extending outwardly from the central core, an elongate strip having a cutting edge mounted at the outer end of each arm, each cutting edge having an elongate acute tip for scrubbing dirt or soot from the inner surface of a tube.

2. A rotary tube scrubber as defined in claim 1 which is fabricated of durable plastic.

3. A tube scrubber comprising a one piece elongate body symmetrical about its longitudinal axis, the body having a central core with an axial stem for connection to a rotary driving device, three curved flexible web-like arms spaced about the circumference of the core and extending outwardly from the central core, an elongate strip having a cutting edge mounted at the outer end of each arm, each cutting edge having an elongate acute tip for scrubbing dirt or soot from the inner surface of a tube, and the elongate body, web-like arms and elongate strips having substantially the same length.

4. A rotary tube scrubber as defined in claim 3 in which each flexible web-like arm is a curved plane approximating the shape of one-fourth of a cylinder wall defined by parallel inner and outer edges.

5. A rotary tube scrubber as defined in claim 4 the inner edge of each flexible arm is integral with the core with the arm projecting outwardly from the core curving approximately 90° from the line of attachment and terminating at the outer edge.

6. A rotary tube scrubber as defined in claim 4 in which the flexible arms flex to accommodate a range of tube diameter sizes.

7. A rotary tube scrubber as defined in claim 4 in which the adjacent flexible arms define longitudinal passages through the scrubber for free flow of flushing air and water in a tube.

8. A rotary tube scrubber as defined in claim 3 in which the forward end of the cutting edge strips is trimmed for ease of inserting the scrubber into a tube opening.

9. A self-sharpening tube scrubber comprising a central core with stem for connection to a rotary driving device, a plurality of flexible arms spaced about the circumference of the core and extending outwardly from the central core, an elongate strip having a cutting edge mounted at the outer end of each arm, each cutting edge having an elongate acute tip for scrubbing the inner surface of a tube, and the cutting edge being self-sharpening by rotary engagement with the tube inner-surface.

10. A tube scrubber comprising an elongate body having a central core with threaded stem for connection to a rotary driving device, three flexible arms spaced 120° about the about the circumference of the core and extending outwardly from the central core, an elongate strip having a cutting edge mounted at the outer end of each arm, each cutting edge having an elongate acute tip for scrubbing dirt or soot from the inner surface of a tube.

* * * * *